United States Patent [19]

Konrath

[11] 4,208,999

[45] Jun. 24, 1980

[54] RPM REGULATOR FOR FUEL INJECTION PUMPS

[75] Inventor: Karl Konrath, Ludwigsburg, Fed. Rep. of Germany

[73] Assignee: Robert Bosch GmbH, Stuttgart, Fed. Rep. of Germany

[21] Appl. No.: 916,312

[22] Filed: Jun. 16, 1978

[30] Foreign Application Priority Data

Jul. 15, 1977 [DE] Fed. Rep. of Germany ..... 2731968

[51] Int. Cl.[2] ..... F02D 1/04; F02M 39/00

[52] U.S. Cl. ..... 123/140 R; 123/139 BD; 123/139 AD

[58] Field of Search ..... 123/140 R, 139 BD, 139 AD

[56] References Cited

U.S. PATENT DOCUMENTS

| | | | |
|---|---|---|---|
| 3,884,206 | 5/1975 | Ritter | 123/140 R |
| 3,946,715 | 3/1976 | Staudt | 123/140 R |
| 3,970,064 | 7/1976 | Eheim | 123/140 R |
| 3,970,066 | 7/1976 | Schmitt | 123/140 R |
| 3,974,812 | 8/1976 | Konrath | 123/140R |
| 3,974,814 | 8/1976 | Eheim | 123/140 R |

*Primary Examiner*—Charles J. Myhre
*Assistant Examiner*—Carl Stuart Miller
*Attorney, Agent, or Firm*—Edwin E. Greigg

[57] ABSTRACT

An rpm regulator for a fuel injection pump for an internal combustion engine such as an injection pump controlled by an annular slide connected to a lever-controlled adjustment device which acts in a regulating manner to effect a delivery quantity decrease as the rpm increases in a positive adjustment, the regulator including a double-armed intermediate lever, whose first lever arm is coupled with the delivery quantity adjusting member of the injection pump and whose second lever arm is acted upon by an rpm signal indicator acting against the force of a regulating spring with a single-armed adjustment lever pivotally mounted on and overlying the free end of the second lever arm between the intermediate lever and a drag lever biased by the regulating spring, the adjustment being supported on one side near its axis of rotation at a hinge point on the drag lever and on the other side on the intermediate lever by engagement of its free end with an elastically yielding stop.

9 Claims, 5 Drawing Figures

RPM REGULATOR FOR FUEL INJECTION PUMPS

BACKGROUND OF THE INVENTION

The invention relates to an rpm regulator or rpm governor for fuel injection pumps of internal combustion engines. The present invention is concerned, more particularly, with an rpm regulator for annular slide-controlled injection pumps having a double-armed intermediate lever which is pivotable about an axis fixedly mounted in the housing, whose first lever arm is coupled with the delivery quantity adjusting member of the injection pump, and whose second lever arm, which is acted upon by an rpm signal indicator, is adjustable in accordance with the rpm against the force of at least one main regulating spring. The second lever arm supports on its free end an axis of rotation of a single-armed adjustment lever which is disposed between the intermediate lever and a drag lever subject to the force of the regulating spring. The adjustment lever is supported on the drag lever at a tilt point lying between its axis of rotation and the axis of the rpm signal indicator and the free end of the drag lever cooperates with an elastically yielding stop disposed between the axis of the rpm signal indicator and the axis of rotation of the intermediate lever. An rpm regulator of this type is known (DT-OS No. 24 02 372) in which the rpm signal indicator acts on the intermediate lever by means of the elastically yielding stop. As the rpm increase, the adjustment lever causes an increase in the fuel delivery quantity, i.e., a negative adjustment acting in a deregulating manner. A positive adjustment, wherein a decrease in the fuel delivery quantity is effected as the rpm increase, cannot be accomplished with this known regulator.

An rpm regulator of a similar construction is also known which is capable of causing a positive adjustment of the fuel delivery quantity. This regulator, however, which is otherwise structurally similar, has no adjustment lever, but rather the second lever arm of the intermediate lever is supported directly on the drag lever by means of an elastically yielding stop located on its free end. In this manner a positive adjustment can be attained. However, this regulator has the disadvantage in that the spring seat must perform relatively short control paths with small spring forces. The spring stroke and force are therefore difficult to adjust. This is especially disadvantageous when the annular slide of an annular slide-controlled distributing injection pump serves as the delivery quantity adjustment member. In this case, the activating paths and therefore the slide stroke for an adjustment are extremely small. In comparison with the adjustment control paths of about 1 mm for the regulating rod serving as the delivery quantity adjusting member in chamfer-controlled series injection pumps, slide strokes of only about 0.2 mm are required for the delivery of equally large quantity changes in slide-controlled distributing injection pumps. In order to be able to control such small adjustment strokes with sufficient precision, the largest possible transfer of the control path (adjustment strokes) of the delivery quantity adjusting member onto the stroke (adjustment control stroke) of the elastically yielding stop which determines the adjustment is necessary.

OBJECT AND SUMMARY OF THE INVENTION

By the novel construction of the rpm regulator according to the invention, it is possible to advantageously effect a positive adjustment while maintaining small dimensions of the regulator elements and with a sufficiently large transfer of the adjustment stroke of the delivery quantity adjusting member, which is preferably formed as an annular slide, onto the adjustment control stroke of the elastically yielding stop. In this manner a delicate, precise setting of the adjustment is possible even with small spring forces and large spring paths.

Thus the possibility of diminishing the sensitivity of the regulator is lessened by the arrangement of the elastically yielding stop in the second lever arm of the intermediate lever, because the adjusting lever is very easily manufactured and the top is located near the axis of rotation of the intermediate lever. The intermediate lever, which is formed as a flexible stamped member having a U-shaped cross section, offers a mount for the stop bolt of an elastically yielding (and therefore easy to manufacture) stop in a strap-like element that is bent at an angle to its crosspiece. Another simplified embodiment of the elastically yielding stop is obtained by the arrangement of a first mounting point for the stop bolt in the crosspiece of the second lever arm of the intermediate lever and by a second mounting point in a crosspiece manufactured as a bore, which crosspiece bridges the distance between the two shanks of the intermediate lever and is attached thereto.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
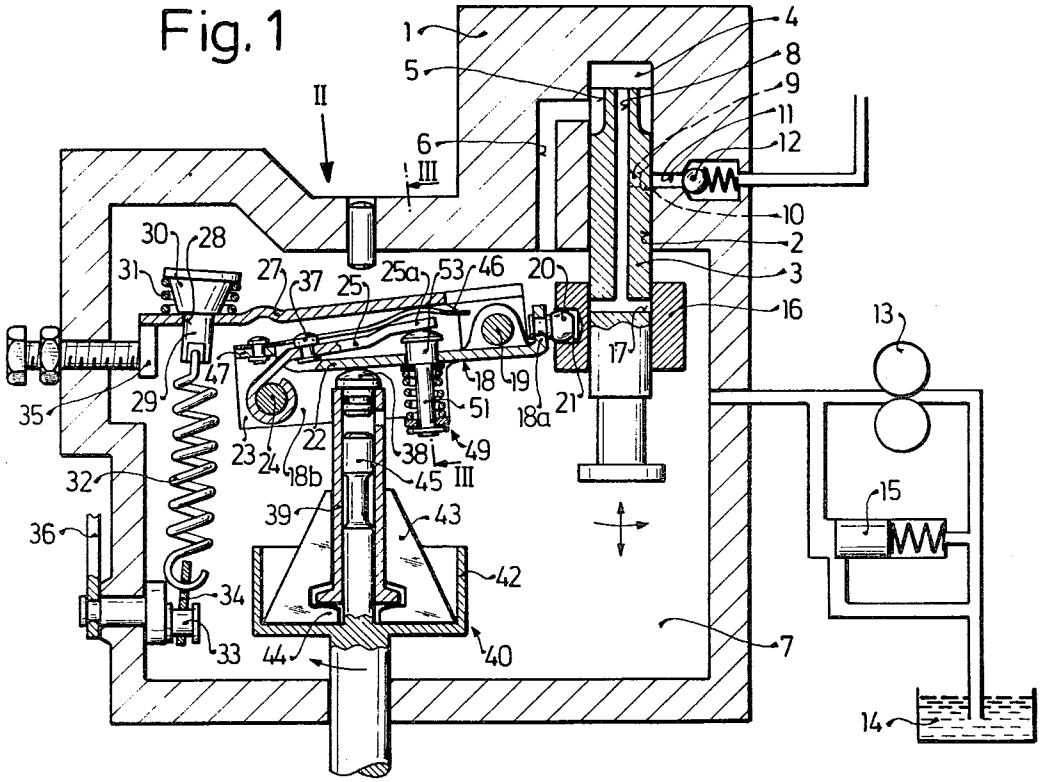
FIG. 1 is a cross-sectional front elevational view through the first exemplary embodiment of a centrifugal rpm regulator which is built into a distributing injection pump.

The first exemplary embodiment of the rpm regulator according to the invention as shown in FIG. 1 consists of a centrifugal rpm regulator which is built into a housing 1 of a stroke piston-distributing injection pump.

As shown in the drawing, an illustrative embodiment of a speed regulator according to the present invention includes a housing 1 of a fuel injection pump having a pump piston 3 which is displaceable in a simultaneous reciprocating and rotating movement in a cylinder bore 2 by conventional instrumentalities (not shown) against the force of a conventional restoring spring (not shown). The working chamber 4 of the pump is supplied with fuel from a suction chamber 7 via a longitudinal groove 5 disposed in the surface of the piston 3 and via a channel 6 disposed in the housing 1 for as long as the piston 3 makes its intake stroke and takes its lower dead center position. As soon as the channel 6 has been closed after commencement of the compression stroke and after a corresponding rotation of the piston 3, the fuel in the pump working chamber 4 is conveyed along a longitudinal channel 8 provided in the piston 3. From the longitudinal channel 8 the fuel is supplied via a branching radial bore 9 and a longitudinal distribution groove 10 disposed in the surface of the piston to one of the pressure lines 11. The pressure lines 11 are distributed at the perimeter of the cylinder bore 2 in correspondence with the number of cylinders (not shown) to be supplied. Each of the pressure lines 11 runs via a respective check valve 12 opening in the flow direction to the injection valves (not represented) of the individual cylinders of the internal combustion engine supplied by this injection pump.

The suction chamber 7 is supplied with fuel via a delivery pump 13 from a fuel storage container 14. The pressure of the fuel in the suction chamber 7 is controlled, in a manner known per se, by a pressure control valve 15, and excess fuel is led back to the fuel container 14.

An annular slide 16 surrounds and is displaceable on the piston 3. This slide 16 regulates a radial bore 17 which communicates with the longitudinal channel 8 during the compression stroke of the pump piston 3 and thus determines the end of delivery, i.e., determines the delivery quantities supplied by the pump piston 3 into the pressure lines 11. The remaining fuel delivered by the piston 3 is not supplied to the pressure lines 11 but rather flows back into the suction chamber 7.

The axial position of the annular slide 16, which serves as a delivery quantity adjustment member of the injection pump, is controlled with regard to the position of the radial bores 17 in the pump piston 3 by a double-armed intermediate lever 18 of the centrifugal rpm regulator built into the suction chamber 7 of the pump. The intermediate lever 18 is pivotable about an axis defined by a shaft 19, which is disposed in the pump housing 1 and supports a ball-shaped pin 20, which serves as a carrier, on a bent, shot first lever arm 18*a*, and which engages in an opening 21 of the annular slide 16. A bolt-like axis 24 is mounted on the extreme end of the second lever arm 18*b* of the intermediate lever 18 in two shanks 23 which are bent outward from a cross-piece 22 of the lever arm 18*b*. An adjustment lever 25 is rotatable around this axis 24 in the same plane as the intermediate lever 18. The adjustment lever 25 extends in the direction of the axis defined by the shaft 19 and thus shares a hinged overlapping relationship with the arm 18*b* of the intermediate lever 18, and runs nearly parallel thereto. Viewed from the pump piston 3 drive side, the adjustment lever 25 is disposed on the other side of the intermediate lever 18.

A one-armed drag lever 27 is also pivotable about the axis defined by the shaft 19 independently of the intermediate lever 18, and, pointing away from the annular slide 16, runs nearly parallel to the lever arm 18*b* of the intermediate lever 18. The main position of the drag lever 27 is in overlapping relationship with the intermediate lever 18 such that the adjustment lever 25 is disposed between the intermediate lever 18 and the drag lever 27. The drag lever 27 includes a shoulder and near its free end is a bore 28 through which a bolt 29 is guided. Viewed from the pump piston 3 drive side, this bolt 29 includes a head 30 on the other side of the drag lever 27. An idling spring 31 is disposed between the head 30 and the drag lever 27. A main control spring 32 in the form of a tension spring is connected to the other end of the bolt 29. The main control spring 32 is secured to an arbitrarily adjustable lever 33 connected to lever 36 at its other end by a clip 34. The lever 33 is used to adjust the biasing of the main control spring 32 and also to adjust the load. As a result of the biasing of the main control spring 32 the drag lever 27 is pressed by its free end against an ajustable stop 35, which is mounted in the housing 1.

Adjacent to its axis defined by shaft 24, the adjustment lever 25 includes a stop 37, which serves as a hinge point, projecting in the direction of the drag lever 27, and its free end is supported on an elastically yielding member 49, which is described in more detail below. Between the shaft 24 and the member 49 arranged in the lever arm 18, the intermediate lever 18 contacts a semi-spherical lug 38 of an adjusting sleeve 39 of a centrifugal governor 40. The centrifugal force governor 40 is driven by conventional gearing (not shown) according to the speed of the pump piston 3 and is provided with a carrier 42 having compartments in which centrifugal weights 43 are disposed. The centrifugal weights engage with nose-shaped pressure arms 44 on the lower edge of the adjustment sleeve 39 which is displaced in its longitudinal axial direction on a shaft 45 of the centrifugal governor 40. Instead of the centrifugal governor 40, which serves as an rpm-dependent adjustment member or rpm signal indicator, other adjustment members activated by, for example, hydraulic or pneumatic pressure can engage the same engagement point on the intermediate lever 18.

In close proximity to the rotational axis 24 of the adjustment lever 25, which is mounted in the second lever arm 18*b* of the intermediate lever 18, a starting spring in the form of a leaf spring 46 is attached to a member 47, which forms an angle to the shank 23 of the intermediate lever 18. The leaf spring 46 is thus arranged to extend nearly parallel to the intermediate lever 18, the adjustment lever 25 and the drag lever 27 in the central space between the intermediate lever 18 and the drag lever 27. This spring 46 has a forward portion which is supported on the drag lever 27, and includes an opening 48 for the passage of the adjustment lever 25.

Figure 2:
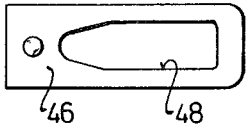
FIG. 2 is a top plan view in the direction of the arrow II in FIG. 1 of the starting spring which is formed as a leaf spring.

FIG. 2 shows a plan view of the leaf spring 46 provided with the opening 48.

Figure 3:
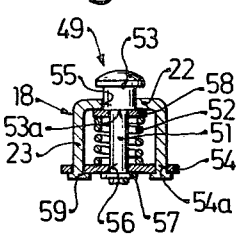
FIG. 3 is a cross-sectional view through the elastically yielding stop in FIG. 1 along the line III—III.

FIG. 3 shows the elastically yielding stop 49 which is positioned in the second lever arm 18*b* of the intermediate lever 18 between the axis of the centrifugal governor 40 and the pivotal axis 19 of the intermediate lever 18.

The stop 49 basically consists of a stop bolt 51 and an adjustment spring 52, which is formed as a compression spring. One end of this compression spring 52 is supported on a shoulder 53*a* of a head 53 of the stop bolt 51, and the other end is supported on a crosspiece 54, which bridges the distance between the two shank portions 23 of the intermediate lever 18 and is attached thereto. In FIG. 3 the U-shaped cross section of the second lever arm 18*b* of the intermediate lever 18 can clearly be seen. The intermediate lever 18 includes a web 22, into which is machined a bore 55 as a first mounting location for the stop bolt 51. A bore 56, which is coaxial to the bore 55, and is arranged in the crosspiece 54, serves as a second mounting location for the stop bolt 51. The movement of the stop bolt 51, which is caused by the adjustment spring 52 and is directed toward the adjustment lever 25, is limited by a safety disc 57 which serves as a stroke stop, and thus the stop bolt 51 is held in the position shown in FIGS. 1 and 3. A disc 58, which is placed between the adjustment spring 52 and the shoulder 53*a* on the stop bolt 51, serves to improve the support of the spring 52 on the stop bolt 51. By placing more discs at this particular location the biasing of the adjustment spring 52 can be increased (not shown). A change of the adjustment control stroke caused by the stop bolt 51 can be obtained by changing the length of the bolt 51 or by placing intermediate discs between the safety disc 57 and the crosspiece 54 (not shown). The crosspiece 54 is riveted to the intermediate lever 18 in a simple manner without additional assisting means by means of pins 59, which project out of the shank portions 23 of the intermediate lever 18 and extend through openings 54*a* in the cross-piece 54. The pins 59 are in front of the rivets' rectangular projections on the shank portions 23 of the intermediate lever 18 and can be produced without additional costs merely by stamping this steel sheet element. The associated openings 54*a* in the cross-piece 54 are accordingly produced in rectangular form, and the portion of the pin 59 which projects above the cross-piece 54 forms (after riveting) the rivet head which holds the cross-piece 54.

Figure 4:
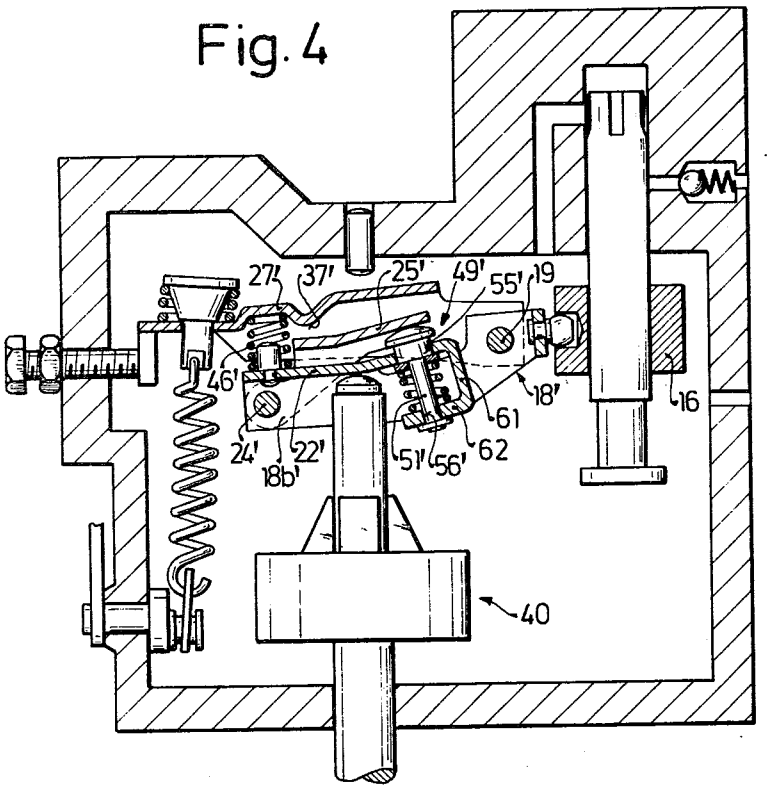
FIG. 4 is another cross-sectional view through the second exemplary embodiment of this invention.

In the second exemplary embodiment shown in FIG. 4, elements similar to those in the first exemplary embodiment are given the same reference numerals, and slightly altered elements are provided with a prime. This exemplary embodiment is distinguished from the structure in FIGS. 1 through 3 only by a modified lever arrangement. Thus, the second lever arm 18*b*' of the intermediate lever 18', which transfers the adjusting movement of the centrifugal governor 40 onto the annular slide 16, is provided with a U-shaped element 61, which is angled away from the web 22' and is located in close proximity to the the elastically yielding stop 49'. A stop bolt 51' of the stop 49' has a first mounting location 55' in the web 22' of the lever arm 18*b*'—as in the first exemplary embodiment—and a second mounting location 56' in a side wall 62 of the U-shaped element 61 which lies opposite the web 22'.

An adjustment lever 25' has its axis of rotation 24', as in the first exemplary embodiment, on the extreme free end of the second lever arm 18*b*', and it extends nearly parallel to this lever arm 18*b*' and to a drag lever 27' mounted on the axis 19, which has a projection 37' as a tipping point for the adjustment lever 25', which projection 37' has the same function as the stop bolt 37 in FIG. 1. Above the pivotal axis 24' of the adjustment lever 25' a compression spring 46' is interposed between the intermediate lever 18' and the drag lever 27', and this serves as a starting spring supported on both levers. In this exemplary embodiment a leaf spring can be used, of course, instead of the compression spring 46' and could be placed between the levers 27' and 18'.

The intermediate lever 18' is provided in the area of its second lever arm 18*b*', as is the corresponding lever arm 18*b* of the intermediate lever 18 of the first exemplary embodiment, with a U-shaped cross section according to FIG. 3 of the first exemplary embodiment. The adjustment lever 25' also has a U-shaped cross section and encloses the corresponding portion of the intermediate lever 18' in the area of its pivotal axis 24'.

Figure 5:
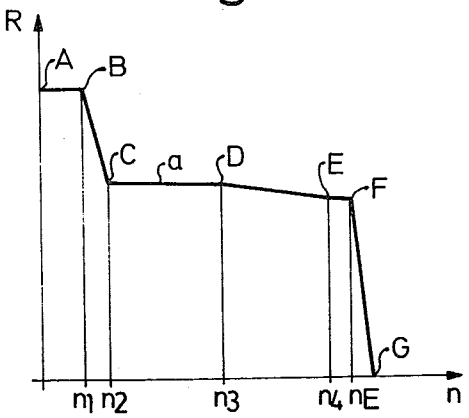
FIG. 5 is a diagrammatic view of a regulating curve made possible by the invention.

The diagram according to FIG. 5 serves to explain the function of the exemplary embodiment shown in FIGS. 1 through 4.

The rpm n of the internal combustion engine or of the pump drive shaft is shown in the abscissa and the position R of the annular slide which serves as the delivery quantity adjusting member is shown in the ordinate in a greatly enlarged scale. The line a shows the curve of the regulating path R over the rpm n for an rpm regulator constructed according to FIGS. 1 or 4 between the points A through G from the idling condition of the internal combustion engine through to the de-regulated condition where the end rpm $n_E$ is exceeded.

With the aid of FIG. 1 the function of the first exemplary embodiment will now be explained.

In the starting position, which is indicated in the drawing, the drag lever 27 abuts against its full load adjustable stop 35 under the action of the main control spring 32, the idling spring 31 being compressed thereby. Under the action of the starting spring 46, which is formed as a leaf spring supported on the drag lever 27, the intermediate lever 18 is pressed into its extreme counterclockwise position and its second lever arm 18*b* abuts the pressure bolt 38 of the adjusting sleeve 39. As a result, the annular slide 16, which serves as the delivery quantity adjusting member and which determines the delivery quantity of the injection pump, is moved into the upper starting position. The centrifugal weights 43 of the centrifugal force governor 40 are still in the starting position at this point. The adjusting sleeve 39 remains in its original position A as shown in FIG. 5 and maintains this position up to point B and the rpm $n_1$, namely the point corresponding to the biasing of the starting spring 46. When this biasing is overcome by the increasing rpm, the adjusting sleeve 39 presses the second lever arm 18*b* of the intermediate lever 18 into a position corresponding to point C in FIG. 5, where at the rpm $n_2$ its stop bolt 37 abuts on the drag lever 27. This position is held by the intermediate lever 18 up to the rpm $n_3$ and the point D of the curve a, because the corresponding biasing of the adjustment spring 52 causes the adjustment lever 25 and the intermediate lever 18 to act as a single rigid lever until this rpm is reached. When the rpm $n_3$ is surpassed, and the sleeve force exerted by the centrifugal governor 40 has increased accordingly, the stop bolt 51 of the elastically yielding stop 49 is deflected. This action causes the adjustment lever 25 to perform a clockwise tipping movement about its contact point between the stop bolt 37 and the drag lever 27. When this tipping motion is performed, the pivotal axis 24 is moved toward the drag lever 27' and the intermediate lever 18 rotates sufficiently to cause a positive adjustment. The adjusting sleeve 39 is also retracted from point D to point E until the rpm $n_4$ is reached, according to a change in the regulating path. The adjusting sleeve 39 remains in this position until the deregulation begins at the final rpm $n_E$ at point F, and the adjusting sleeve 16 is retracted into its stop position G, according to the stiffness of the main regulating spring 32.

With an accordingly designed adjustment spring 52 the point E can coincide with the point F, and the point D, which designates the beginning of the positive adjustment, is determined by the biasing of the spring 52, and can also be associated with a different rpm by changing this biasing. In an extreme case D can also coincide with C.

The second exemplary embodiment according to FIG. 4 operates in the same manner as the first exemplary embodiment according to FIG. 1, except that the beginning and ending of the increased starting quantity between the points A and C in FIG. 5 are not controlled by a leaf spring, but by the starting spring 46', which is formed as a compression spring.

The described lever arrangement allows a favorable use of the limited structural space, especially in a distributing injection pump, and by the selection of the position of the elastically yielding stop 49 between the axis of the centrifugal governor 40 and the pivotal axis 19 of the intermediate lever 18, by the arrangement of the tipping point 37 between the axis of the centrifugal governor 40 and the pivotal axis 24 of the adjustment lever 25 as well as its hinging on the extreme end of the second lever arm **18*b* of the intermediate lever 18, and by the hinging of the annular slide 16 on the short lever arm 18*a* of the intermediate lever 18, a very fine, delicately sensitive control of the adjustment control movement is possible. Because the adjustment stroke of the annular slide between D and E in FIG. 5, in practice, is generally no more than about 0.2 mm, as compared to an adjustment stroke of about 1 mm with the regulating rod of a series injection pump, the extremely strong transfer from the annular slide stroke to the adjustment control stroke of the stop bolt 51 is very advantageous. Thus, in the described exemplary embodiments, by means of the transfer of the intermediate lever 18 and the additional transfer of the adjustment control path through the adjustment lever 25, a transfer ration of 1:12 is attained. Therefore the adjustment spring 52 can perform a large adjustment control stroke, when there is a sufficiently low spring stiffness, which, as already described, can be delicately adjusted by the interposition of intermediate discs. Should it be more advantageous, the described elastically yielding stop 49 described in FIGS. 1 and 3 or 49' described in FIG. 4** can be exchanged for a known adjustment capsule, which, in turn, can be adjustably, in fact pre-adjustably, exchanged in position with an existing device.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. An rpm regulator for a fuel injection pump of an internal combustion engine such as an annular slide-controlled injection pump including a housing, a delivery quantity adjustment member and an rpm signal indicator in said housing, at least one main regulating spring in said housing, a double-armed intermediate lever pivotable about an axis fixedly mounted in said housing and having a first lever arm coupled with said delivery quantity adjusting member of the injection pump and a second lever arm acted upon by said rpm signal indicator adjustable in accordance with the rpm against the force of said at least one main regulating spring, a drag lever subject to the force of said regulating spring, a single-armed adjustment lever, said second lever arm having a free end for supporting an axis of rotation of said single-armed adjustment lever, said adjustment lever being disposed between said intermediate lever and said drag lever, said adjustment lever being supported on said drag lever at a tilt point lying between its axis of rotation and the axis of said rpm signal indicator, an elastically yielding stop disposed between the axis of said rpm signal indicator and the axis of rotation of said intermediate lever, said adjustment lever having a free end arranged to cooperate with said elastically yielding stop, characterized in that said elastically yielding stop is supported on said second lever arm of said intermediate lever and wherein the free end of said adjustment lever is supported on said elastically yielding stop and said rpm signal indicator directly engages said intermediate lever.

2. An rpm regulator according to claim 1, wherein said elastically yielding stop is disposed in the second lever arm of the intermediate lever between the pivotal axis of said intermediate lever and the point of engagement of said rpm signal indicator with said intermediate lever.

3. An rpm regulator according to claim 2, wherein said elastically yielding stop comprises a stop bolt having a shoulder means for mounting said stop bolt in the second lever arm of said intermediate lever at two spaced-apart mounting locations, an adjusting spring clamped between said two mounting locations, and means for supporting one end of said adjusting spring at one of said mounting locations and for supporting the other end of said adjusting spring on said stop bolt shoulder

4. An rpm regulator according to claim 3, wherein at least the second lever arm of said intermediate lever is in the form of a flexible stamped member, said member being U-shaped in cross section across its longitudinal axis to provide spaced-apart shank portions into which the pivotal axis of said intermediate lever and the pivotal axis of said adjustment lever project.

5. An rpm regulator according claim 4, wherein the second lever arm is provided with a web having a bore, said web bore defining one of said mounting locations for said stop bolt and including a cross-piece having a bore mounted on said shank portions with said crosspiece bore in coaxial relationship with said web bore, said crosspiece extending between said shank portions and defining the other of said mounting locations.

6. An rpm regulator according to claim 5, including a pin on each of said shank portions for riveting said crosspiece to said intermediate lever, said crosspiece having an opening in each of said shank portions and said pin projecting out of said shanks through said openings.

7. An rpm regulator according to claim 4, wherein the second lever arm of said intermediate lever is provided with a web having a bore, said web bore defining one of said mounting locations for said stop bolt, and said second lever arm having a U-shaped element disposed at an angle relative to the web of said second lever arm, said U-shaped element including a side wall having a bore defining said second mounting location, and said side wall bore being disposed in coaxial relationship with said web bore.

8. An rpm regulator according to claim 1 wherein said drag lever is pivotally mounted on the pivot axis of said intermediate lever and extends substantially parallel to the second lever arm of said intermediate lever and including a leaf spring mounted at one end on said intermediate lever adjacent the pivot axis of said adjustment lever, said leaf spring extruding within the space between said intermediate lever and said drag lever in supported engagement with said drag lever to serve as a starting spring, said leaf spring having an opening for accomodating said adjustment lever.

9. An rpm regulator according to claim 1 wherein said drag lever is pivotally mounted on the pivot axis of said intermediate lever and extends substantially parallel to the second lever arm of said intermediate lever and including a compression spring supported on said intermediate lever and said drag lever at the level of the pivot axis of said adjustment lever to serve as a starting spring.

* * * * *